US005520105A

United States Patent [19]

Healy

[11] Patent Number: 5,520,105

[45] Date of Patent: May 28, 1996

[54] COMBINATION CAN CRUSHER, JUICER AND SLICER

[76] Inventor: Jack Healy, 11333 Moorpark St., #128, Toluca Lake, Calif. 91602

[21] Appl. No.: 239,305

[22] Filed: May 6, 1994

[51] Int. Cl.[6] ..... B30B 1/24; B30B 9/02; B30B 9/32

[52] U.S. Cl. ..... 100/98 R; 83/437; 83/858; 83/932; 99/508; 99/545; 99/584; 100/103; 100/125; 100/257; 100/288; 100/902

[58] Field of Search ..... 100/94, 98 R, 100/102, 103, 125, 257, 274, 280, 288, 902; 83/425.3, 437, 613, 633, 856–858, 932; 99/506, 508, 537, 543, 545, 584

[56] References Cited

U.S. PATENT DOCUMENTS

| | | | |
|---|---|---|---|
| 752,884 | 2/1904 | Carmichael | 100/288 |
| 783,300 | 2/1905 | McGrath | 100/288 |
| 789,623 | 5/1905 | McGrath | 100/288 |
| 1,038,543 | 9/1912 | Eames | 100/288 |
| 1,813,954 | 7/1931 | Rice | 100/257 |
| 1,867,657 | 7/1932 | Dellinger | 83/437 |
| 1,947,153 | 2/1934 | Dellinger | 83/437 |
| 2,245,978 | 6/1941 | Hyland | 83/858 |
| 2,507,963 | 5/1950 | Davitcho . | |
| 2,509,190 | 5/1950 | Langley | 99/545 |
| 2,693,210 | 11/1954 | Gustafson . | |
| 2,703,522 | 3/1955 | Smith | 100/283 |
| 4,345,519 | 8/1982 | Sabino | 100/215 |
| 5,188,024 | 2/1993 | Li | 100/274 |
| 5,245,902 | 9/1993 | Pereira | 83/437 |

FOREIGN PATENT DOCUMENTS

| | | | |
|---|---|---|---|
| 119557 | 4/1901 | Germany | 100/288 |

*Primary Examiner*—Stephen F. Gerrity
*Attorney, Agent, or Firm*—Poms, Smith, Lande & Rose

[57] ABSTRACT

A combination can crusher, juicer and slicer having a main housing with a vertically adjustable cutting blade holder or can holder and a ratcheted lever adapted to raise and lower a pressure plate into contact with either a can disposed in the holder or a cutting blade retained in the holder. Moving the pressure plate, which will vary depending on the operation desired, downwardly against a can disposed in the holder crushes the same. Moving the pressure plate downwardly against a mating cutting blade cuts a fruit or vegetable therebetween. Moving the pressure plate downwardly against a mating juicer assembly juices a vegetable or fruit disposed therebetween and juices the same.

12 Claims, 5 Drawing Sheets

FIG. 2
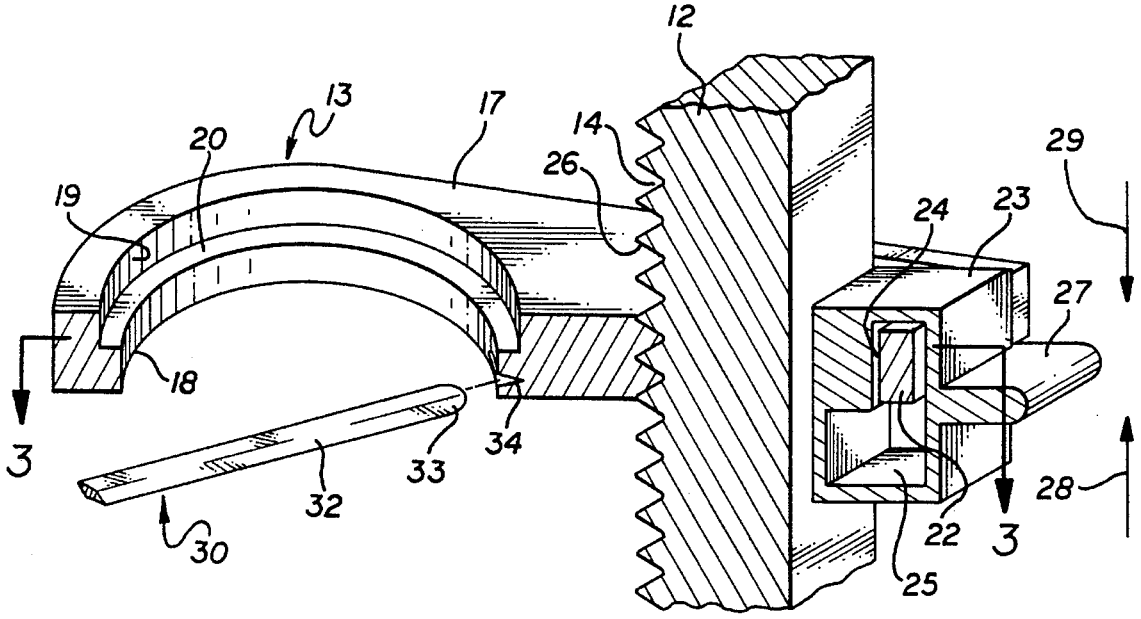
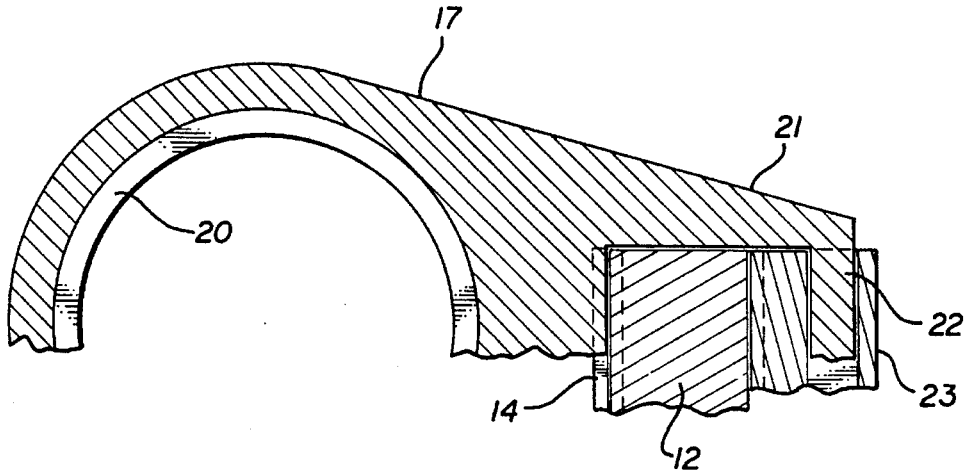
FIG. 3

COMBINATION CAN CRUSHER, JUICER AND SLICER

FIELD OF THE INVENTION

The invention relates to small kitchen appliances; and, more particularly, to a combination can crusher, juicer and slicer.

DESCRIPTION OF THE PRIOR ART

Various small kitchen appliances that can carry out more than a single operation have been suggested in the past. In U.S. Pat. No. 4,345,519 to Sabino, a vertical can crusher is disclosed. However, this is only one operation that the crusher can do. In U.S. Pat. No. 2,693,210 to Gustafson, a combined cutter and slicer is disclosed. However, this device is quite complicated and cannot crush cans. In U.S. Pat. No. 5,188,024 to Li, another can crusher, capable of only a single operation, is disclosed. In U.S. Pat. No. 2,507,963, Davitcho, a juice extractor is disclosed. However, it is difficult to conceive how it could be used to crush cans. Further, there is no cutting blade. Finally, U.S. Pat. No. 5,245,902 discloses a vegetable cutter; however, there is no way to juice fruits or vegetables and no means for crushing a can. U.S. Pat. No. 2,703,522 discloses a fruit juicer. The juice can be modified to rice or shred potatoes, open oysters or crack nuts. However, there is no way to crush cans. Also, the entire means for shredding, juicing, etc., mounted to collar 23, must be removed and replaced with the desired shredding or juicing element or the like.

There is thus a need for a small kitchen appliance that is simple and easy to use and one that can crush cans and juice or slice vegetables or fruits in the same unit.

SUMMARY OF THE INVENTION

It is an object of this invention to provide a combination can crusher, juicer and slicer.

It is a further an object of this invention to carry out the foregoing object using removable blades and/or disks.

It is still further an object of this invention to carry out the foregoing objects using a single kitchen appliance producing a high amount of compressive force with little effort.

These and other objects are preferably accomplished by providing a combination can crusher, juicer and slicer having a main housing with a vertically adjustable cutting blade holder or can holder and a ratcheted lever adapted to raise and lower a pressure plate into contact with either a can disposed in the holder or a cutting blade retained in the holder. Moving the pressure plate, which will vary depending on the operation desired, downwardly against a can disposed in the holder crushes the same. Moving the pressure plate downwardly against a mating cutting blade cuts a fruit or vegetable therebetween. Moving the pressure plate downwardly against a mating juicer blade juices a vegetable or fruit disposed therebetween and juices the same.

BRIEF DESCRIPTION OF THE DRAWING

FIG. 2 is a view taken along lines 2—2 of FIG. 1;

FIG. 3 is a view taken along lines 3—3 of FIG. 2, a portion thereof being omitted for convenience of illustration;

DESCRIPTION OF THE PREFERRED EMBODIMENT

Figure 1:
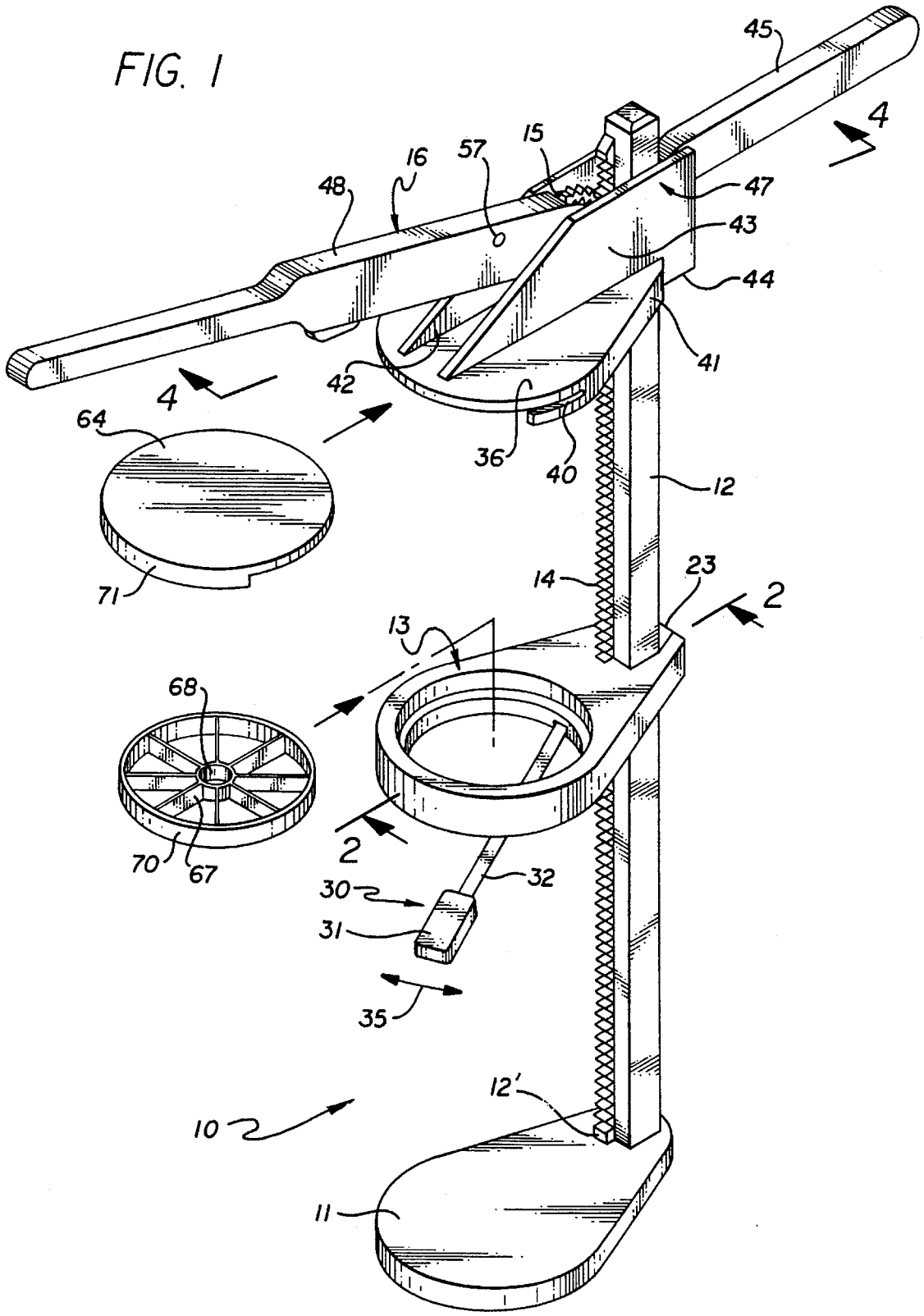
FIG. 1 is a perspective view of a combination can crusher, juicer and slicer in accordance with the teachings of the invention.

Referring now to FIG. 1 of the drawing, a combination 10 is shown that may be used to crush cans and juice or slice fruits or vegetables. Combination 10 includes a base 11, an upstanding vertical post 12 mounted on base 11 and a movable or adjustable can or blade holder 13 mounted on post 12. A rack 14 is used to both adjustably lock holder 13 in position along post 12 and also provide a ratchet by engagement with a gear 15 mounted on a compression plate assembly 16 as will be discussed.

As seen in FIG. 2, rack 14 is an integral part of post 12. Holder 13 includes a holder portion 17 which is generally a round ring in cross-section (FIG. 1) having a first lower portion 18 (FIG. 2) of an inner diameter less than the inner diameter of a second upper portion 19 thereby forming a step or shoulder 20 at the intersection thereof. Holder portion 17 has an integral L-shaped portion 21 (FIG. 3) which straddles post 12 and integral rack 14 terminating in an extension portion 22 extending into a block member 23.

Thus, as seen in FIG. 2, extension portion 22 extends inside of block member 23 which is hollow on the interior and divided into an upper chamber 24 and a lower chamber 25. As seen in FIG. 2, both chambers are rectangular in cross-section with upper chamber 24 being lesser in width than lower chamber 25. Also, extension portion 22 extends into upper chamber 24 and is generally the same width and length thereof in a generally tight fitting relationship. As seen, in this position, holder portion 17, which has gear teeth 26 thereon engaging the teeth of rack 14, is in a meshing relationship therewith. However, by grasping integral handle 27 on block member 23 and moving block member 23 upwardly in the direction of arrow 28 (FIG. 2), extension portion 22 moves down into lower chamber 25 allowing cutter holder 13 to move to the left in FIG. 2 and thus move teeth 26 out of engagement with rack 14 thus unlocking the same allowing holder 13 to be adjusted up or down. When handle 27 is grasped and block member 23 is moved downwardly in the direction of arrow 29, extension portion 22 moves back into upper chamber 24 thus moving teeth 26 back into engagement with rack 14 placing holder 13 back into a locked position.

As seen in FIG. 1, a slicing knife 30 is shown having a handle portion 31 and an integral elongated blade portion 32 with sharp cutting edges on each side thereof. As seen in FIG. 2, end 33 of knife 30 is receivable in a slot 34 in holder portion 17.

Knife 30 is a dicing or slicing knife, as will be discussed, and end 33 is press fit into slot 34 but allowing sufficient movement in the directions of double arrows 35, as seen in FIG. 1 and as will be further discussed.

Figure 5:
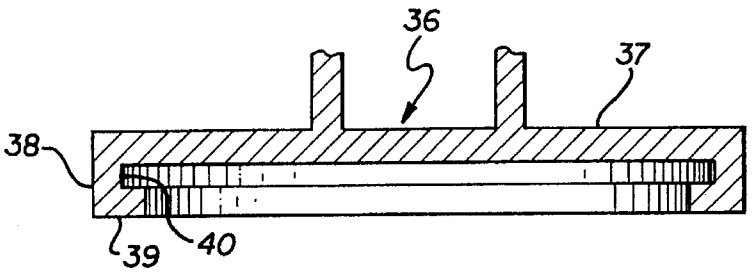
FIG. 5 is a view taken along lines 5—5 of FIG. 4.

Referring back to FIG. 1, compression plate assembly 16 includes a compression plate 36 which, as seen in FIG. 5, has an upper generally round plate portion 37 having a downwardly extending peripheral wall 38 terminating in an inwardly extending peripheral lip 39. As seen in FIGS. 1 and 5, this forms an open slot 40 for receiving a plurality of cutters therein as will be further discussed.

Plate 36 has a rear extension portion 41 (FIG. 1) through which post 12 extends. Plate 36 is fixedly mounted to a pair of upstanding spaced triangularly-shaped flanges 42, 43. As seen in FIG. 1, these flanges 42, 43 having rear portions 44 extending downwardly abutting against the rear extension portion 41.

Figure 4:
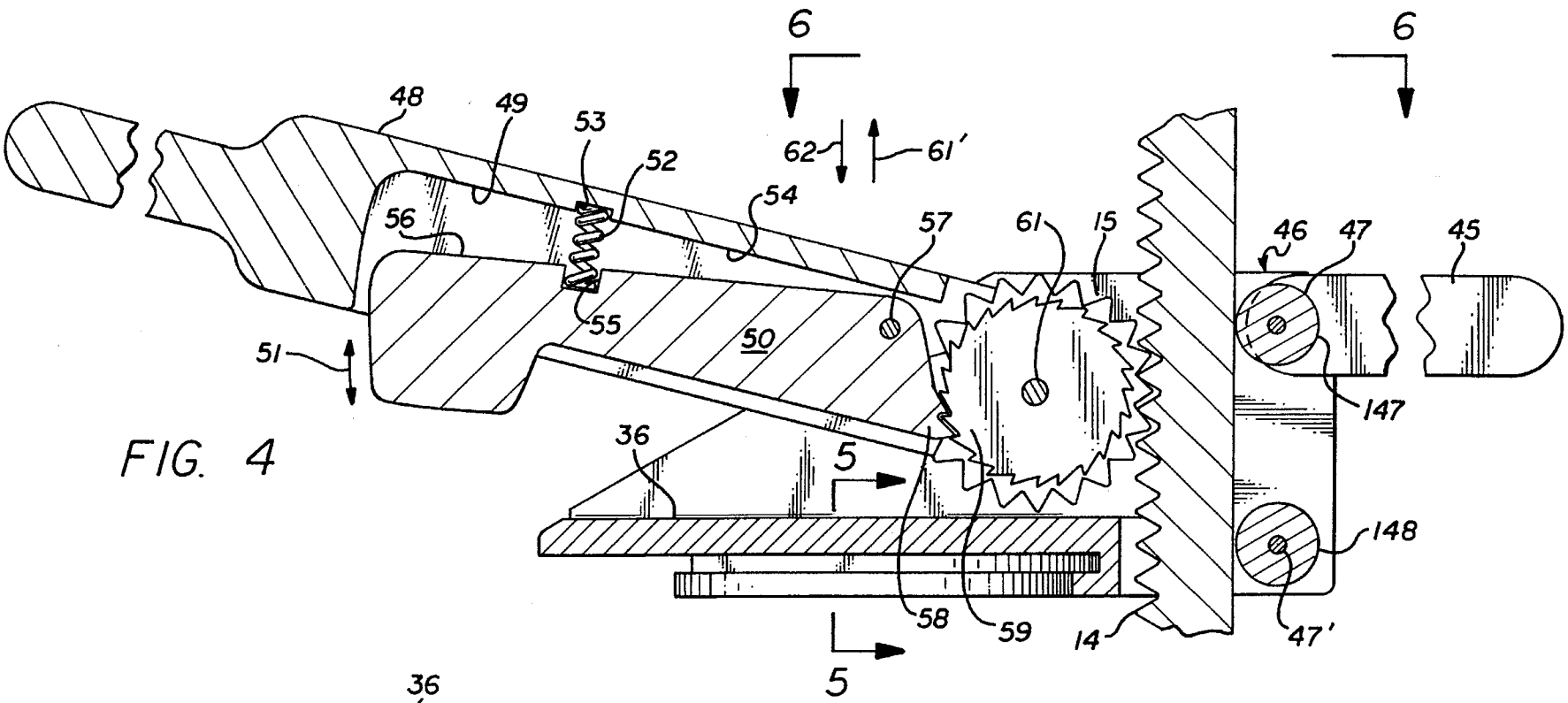
FIG. 4 is a view taken along lines 4—4 of FIG. 1.
Figure 6:
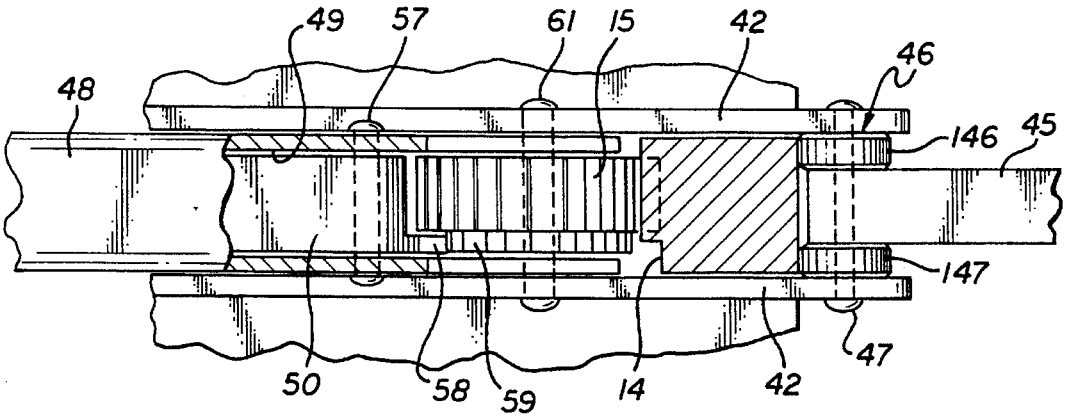
FIG. 6 is a view taken along lines 6—6 of FIG. 4.

A weighted counterbalance stabilizing handle 45 is provided terminating adjacent post 12 in a roller assembly 46 (FIGS. 4 and 6). Roller assembly 46 includes upper and lower rollers (upper rollers 146, 147 — FIG. 6 and lower rollers 148 — only one visible — FIG. 4). Rollers 146, 147 are rotatably mounted, via pin 47, to handle 45 between flanges 42, 43 as seen in FIG. 6. In like manner, bottom rollers 148 are rotatably mounted between flanges 42, 43 by pin 47' (FIG. 5).

An elongated compression handle 48 is provided as part of the compression plate assembly 16 having an inner elongated cavity or slot 49 (FIG. 4) receiving therein a like configured elongated trigger portion 50. Trigger portion 50 is movable within slot 49 in the direction of arrows 51 but normally biased downwardly by means of spring 52 having one end disposed in a hole 53 formed in the inner wall 54 of handle 48 and the other end disposed in a hole 55 formed in the outer wall of trigger portion 50. Trigger portion 50 is retained to handle 48 and within slot 49 thereof by a pivot pin 57 (see also FIGS. 1 and 6) extending through handle 48 and trigger portion 50.

Trigger portion 50, at its rear lower end, terminates in a plurality of pawl teeth 58 engaging the teeth of a pinion gear 59. The teeth of gear 59 are adapted to engage teeth 15, mounted between flanges 42, 43, which teeth 15 are in engagement with teeth 14 of rack 12. Gear 59 is disposed between flanges 42, 43 and rotatable therein by means of pin 61.

Thus, it can be appreciated that moving compression handle 48 up in the direction of arrow 61' in FIG. 4, pawl teeth 58 slip over the teeth of gear 59. Moving handle 48 downwardly in the direction of arrow 62 results in pawl teeth 58 engaging the teeth of gear 59 turning pinion gear 59 counterclockwise as seen in FIG. 4 into engagement with teeth 15 moving plate 36 downwardly along rack 14 with extremely high compressive force at all times. When it is desired to release handle 48, the operator squeezes trigger portion 50 against the bias of spring 52 releasing pawl teeth 58 from engagement with gear 59 allowing plate 36 to be moved back up post 12 to reposition the same for the next operation.

Figure 7:
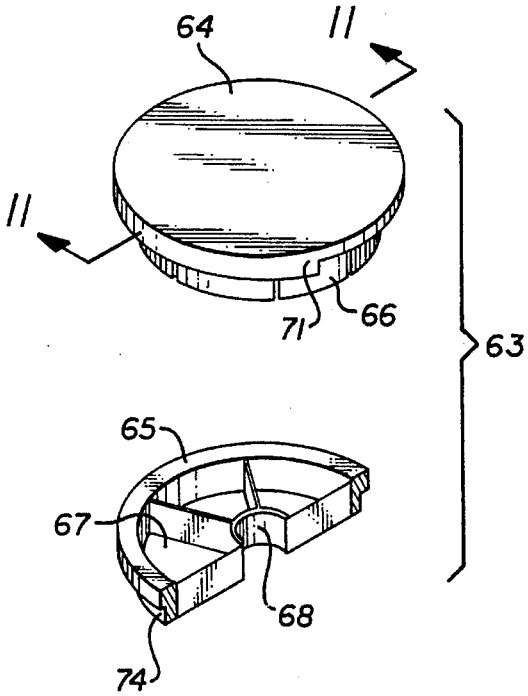
FIGS. 7 through 9 are exploded views of various plate and cutter combinations for carrying out various operations using the combination of FIGS. 1 to 6.
Figure 10:
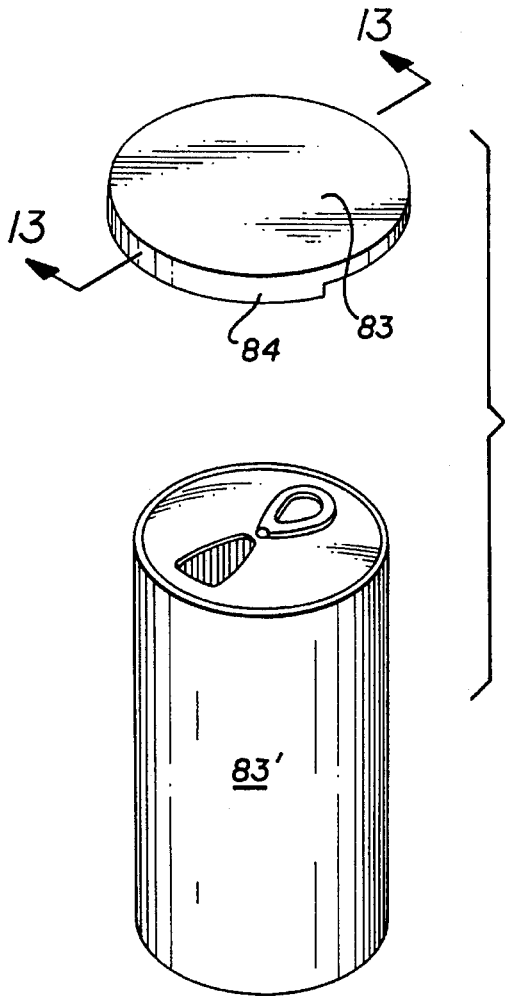
FIG. 10 is a perspective view of a can crusher plate and can in accordance with the teachings of the invention.
Figure 11:
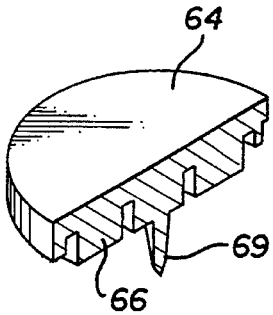
FIG. 11 is a view taken along lines 11—11 of FIG. 7.

A plurality of operations may be quickly and easily carried out using the combination 10. The parts for carrying out four such operations are shown in FIGS. 7 through 10, respectively. Thus, as seen in FIG. 7, an apple coring assembly 63 is shown. Apple coring assembly 63 includes an upper main pressure plate 64 and a lower apple cutter 65. Upper plate 64 is generally a flat circular plate of the same outer diameter as that of slot 40 (FIGS. 5 and 1) and adapted to be removably retained therein. As seen in cross-section in FIG. 11, plate 64 includes a plurality of downwardly extending triangularly spaced protrusions 66 adapted to extend into like configured openings 67 in cutter 65. As seen in FIG. 7, cutter 65 has a central ring shaped opening 68 adapted to receive therein a downwardly extending protrusion or corer 69 as seen in FIG. 11.

Cutter 65 has a lower shoulder portion 74 adapted to rest on top of shoulder 20 in holder 13 as will be discussed.

Pressure plate 64 also has a downwardly extending outer peripheral flange 71.

In operation, pressure plate 64 is inserted into slot 40 of compression plate 36. Cutter 65 is placed into holder 13 with shoulder 74 resting on top of shoulder 20. An apple is placed in holder 13 on top of cutter 65. Handle 48 is moved downwardly as heretofore discussed. Corer 69 extends through the apple and cuts out the core thereof through opening 68 in cutter 65. The triangularly-shaped protrusions 66 push the apple down through like configured openings 67 thus slicing the apple into cored triangularly-shaped segments. Handle 48 is now moved upwardly in the direction of arrow 61' (FIG. 4) and plate 64 and cutter 65 can be quickly and easily removed. Combination 10 is now ready for the next operation.

If desired, during the foregoing operation, as the apple segments move downwardly through openings 67, knife 30 can be moved across the bottom of cutter 65 further dicing or slicing the apple segments.

Figure 8:
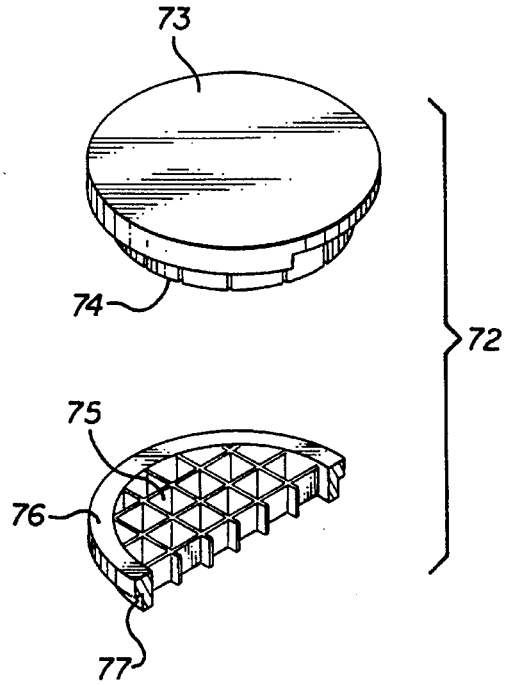

As seen in FIG. 8, combination 10 may be used to make french fries as seen by the plate assembly 72 in FIG. 8. In place of pressure plate 64, a pressure plate 73 is provided also having a generally round flat plate portion 74 and a plurality of downwardly extending spaced protrusions 74. Protrusions 74, however, are square-shaped and configured as openings 75 in lower cutter 76. Cutter 76 also has a shoulder 77 adapted to rest on shoulder 20 of holder 13. Thus, when plate 73 and cutter 76 are mounted in combination 10 as heretofore discussed with respect to plate 64 and cutter 65, a peeled or unpeeled potato placed on top cutter 76 is cut into elongated pieces square-shaped in cross-section (which may be further cut into pieces via knife 30 as the cut pieces pass through openings 75). Further discussion is deemed unnecessary.

Figure 9:
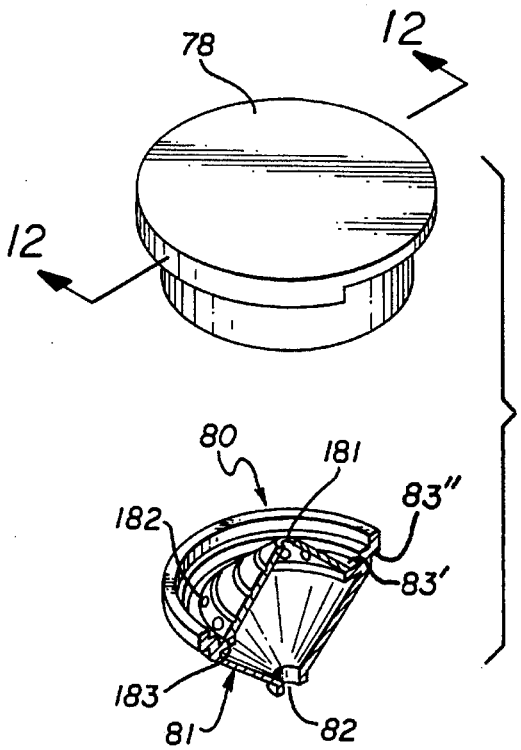
Figure 12:
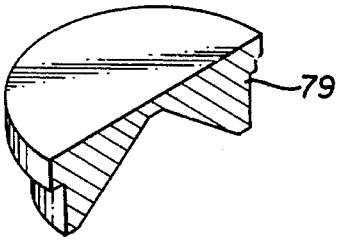
FIG. 12 is a view taken along lines 12—12 of FIG. 9.

Combination 10 may also be used as a juicer as seen by the juicer assembly 77 in FIG. 9. Thus, upper pressure plate 78 is again a generally round plate having a downwardly extending protrusion 79 (FIG. 12). However, as seen in FIG. 12, protrusion 79 is comprised of a generally V-shaped blade to mate with convex insert 80 (FIG. 9) which has a rim 83' which rests on shoulder 183 of the lower conical portion 81 of the juicer assembly. A central hole 82 is provided in lower portion 81 so that juice squeezed by the engagement of protrusion 79 with a fruit or the like placed on top of convex insert 80 can pour from central hole 181 and peripherally spaced holes 182 down hole 82. A lower stepped shoulder 83" is provided on juicer portion 81 for resting on shoulder 20 in holder 13 as heretofore discussed.

Figure 13:
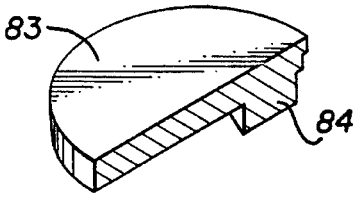
FIG. 13 is a view taken along lines 13—13 of FIG. 10.

Finally, combination 10 can be used to crush cans or the like, such as aluminum cans. A can 83' is merely placed within holder 13 resting on base 11. As seen in FIG. 10, upper can crusher plate 83 is again a generally round flat plate having a downwardly extending flange 84 (FIG. 13). As pressure plate 83 is lowered as heretofore discussed, a can placed inside of holder 13 is crushed by engagement of flange 84 with one side of can 83'.

It can be seen that there is disclosed a combination juicer, slicer and can crusher.

A high amount of squeezing force is produced with very little effort. The force is developed by having a ratchet driven pinion operating against a rack integrated into a rigid column or post attached to a base. The ratchet provides for multiple strokes which greatly increases the mechanical advantage (by 3–4 times) over similar devices that achieve their force with one stroke only.

The trigger release allows the appliance or combination to be reset quickly to the starting position. The cutter holder is designed so that it can be locked in any position along the length of the rack for carrying out different operations. The various cutter and squeezer combinations can be quickly changed from one operation to another.

The combination can perform the following operations in the kitchen in a single appliance:

A. Crushing aluminum cans (without the need to be attached to a wall or counter);

B. Coring an slicing fruits (such as apples, pears, etc.);

C. Cutting potatoes for french fries;

D. Cutting and dicing fruits and vegetables; and

E. Juicing heavy skinned fruits (such as oranges, grapefruits, etc.).

Obviously, although four different types of operations have been described in conjunction with the use of the appliance combination, such as in FIGS. 7 and 10, obviously other combinations of pressure plates and cutters may occur to an artisan. Also, post 12 may be snap fit into hole 12' in base 11 and holder 13 unlocked and removed therefrom. The entire compression plate assembly may also be released from engagement with rack 14 and thus removed from post 12. All of the parts of combination 10, including the various parts in FIGS. 7 to 10 can be placed in a dishwasher for washing. The parts can then be quickly and easily assembled.

Although a specific can crusher, juicer and slicer combination has been disclosed, variations thereof may occur to an artisan and the scope of the invention should be considered as limited only to the scope of the appended claims.

I claim:

1. A combination can crusher, juicer and slicer comprising:

a base;

an elongated post vertically mounted on said base, said post having a toothed rack extending vertically along one side thereof;

a holder mounted on said post, said holder having a toothed extension position with teeth thereon engaging said rack with said post extending therethrough and an integral holding portion having a central opening therethrough, said opening having a shoulder about the inner wall thereof and said rack extending toward said opening;

releasable locking means associated with said extension portion and said post for releasably locking said holder at spaced locations along said post;

an upper pressure plate assembly mounted on said post above said holder, said pressure plate assembly having an extension portion with said post extending therethrough; and a compression handle pivotally mounted to said pressure plate assembly having gearing means engaging said rack whereby downward movement of said handle moves said plate assembly downwardly on said post, said plate assembly including a pressure plate holder thereon for receiving a pressure plate therein.

2. In the combination of claim 1 including releasable means associated with said compression handle for releasing said gearing means from engagement with said rack.

3. In the combination of claim 1 wherein said locking means includes a hollow block member having a first upper compartment of a first width and a second lower compartment of a second width greater than said first width, said holder extension portion having an elongated member integral therewith extending into said block member in one of said compartments, said elongated member having a width generally related to the width of said upper compartment, said teeth of said extension portion engaging said rack when said elongated member is disposed in said upper compartment and disengaging said teeth of said extension portion from said rack when said elongated member is disposed in said lower compartment.

4. In the combination of claim 1 including a slicing knife having one end disposed in a slot formed in said holding portion below said shoulder therein having an integral knife edge extending normal toward the central axis of said opening in said holding portion, said one end being laterally movable within said slot so that said knife edge can be moved across said opening in said holding portion.

5. In the combination of claim 1 including a counterbalance mounted to said post extending in a direction opposite said compression handle for balancing combination.

6. In the combination of claim 1 including releasable means associated with said compression handle for releasing said gearing means from engagement with said rack, said releasable means including a spring biased trigger portion pivotally mounted in a slot in said compression handle, said trigger portion having pawl means thereon normally biased into a position wherein said pawl means engages said gearing means and, when moved against the compression of said spring, releases said pawl means from engagement with said ratchet allowing said compression handle to be moved upwardly on said post out of engagement with said rack.

7. In the combination of claim 1 including an apple core and slicing pressure plate removably mounted in said pressure plate holder, said pressure plate having a plurality of downwardly extending spaced protrusions surrounding a centrally mounted downwardly extending corer blade, and a cutter mounted in said holding portion resting on said shoulder having a plurality of spaced openings therethrough configured similarly to the protrusions of said pressure plate and surrounding a hole from receiving said corer therein.

8. In the combination of claim 7 wherein said protrusions and said openings are generally triangularly-shaped in cross-section.

9. In the combination of claim 1 including a french fry potato pressure plate removably mounted in said pressure plate holder, said pressure plate having a plurality of downwardly extending spaced protrusions, and a cutter mounted in said holding portion resting on said shoulder having a plurality of spaced openings therethrough configured similarly to the protrusions of said pressure plate.

10. In the combination of claim 9 wherein said protrusions and said openings are generally square in cross-section.

11. In the combination of claim 1 including a juicer pressure plate removably mounted in said pressure plate holder, said pressure plate having a downwardly extending protrusion, and a juicer plate mounted in said holding portion and resting on said shoulder, said juicer plate having a concave portion therein adapted to receive said protrusion thereagainst surrounding a central hole therethrough.

12. In the combination of claim 1 including a can crusher pressure plate removably mounted in said pressure plate holder having an upper surface and a lower surface with a downwardly extending flange on said lower surface adapted to engage the top of an aluminum can disposed within said opening through said holding portion and resting on said base to crush the same when said pressure plate is moved downwardly along said rack.

* * * * *